US007949099B2

(12) United States Patent
Klinkowstein et al.

(10) Patent No.: US 7,949,099 B2
(45) Date of Patent: May 24, 2011

(54) COMPACT HIGH VOLTAGE X-RAY SOURCE SYSTEM AND METHOD FOR X-RAY INSPECTION APPLICATIONS

(75) Inventors: Robert E. Klinkowstein, Winchester, MA (US); Ruth E. Shefer, Newton, MA (US)

(73) Assignee: Newton Scientific Inc., Cambridge, MA (US)

( * ) Notice: Subject to any disclaimer, the term of this patent is extended or adjusted under 35 U.S.C. 154(b) by 62 days.

(21) Appl. No.: 12/167,722

(22) Filed: Jul. 3, 2008

(65) Prior Publication Data

US 2009/0010393 A1 Jan. 8, 2009

Related U.S. Application Data

(60) Provisional application No. 60/948,111, filed on Jul. 5, 2007.

(51) Int. Cl.
*H01J 35/18* (2006.01)
*H01J 35/00* (2006.01)

(52) U.S. Cl. ..... 378/121; 378/140

(58) Field of Classification Search ..... 378/119, 378/121, 123, 136, 137, 138, 140
See application file for complete search history.

(56) References Cited

U.S. PATENT DOCUMENTS

| | | | | |
|---|---|---|---|---|
| 2,871,402 | A | 1/1959 | Lempert | |
| 5,781,609 | A | 7/1998 | Gerling | |
| 5,978,447 | A | 11/1999 | Carlson et al. | |
| 6,111,934 | A | 8/2000 | Foerst et al. | |
| 6,128,367 | A | 10/2000 | Foerst et al. | |
| 6,141,401 | A | 10/2000 | Gerling | |
| 6,882,703 | B2 | 4/2005 | Price et al. | |
| 7,218,707 | B2 * | 5/2007 | Holm | 378/121 |
| 2003/0210764 | A1 | 11/2003 | Tekletsadik et al. | |
| 2007/0121788 | A1 | 5/2007 | Mildner et al. | |
| 2007/0237298 | A1 | 10/2007 | Sundaram | |
| 2008/0049902 | A1 | 2/2008 | Holm et al. | |
| 2008/0079525 | A1 | 4/2008 | Sundaram | |
| 2008/0095317 | A1 | 4/2008 | Lemaitre | |

FOREIGN PATENT DOCUMENTS

| | | |
|---|---|---|
| EP | 0488991 | 6/1992 |
| EP | 0924742 | 6/1999 |

OTHER PUBLICATIONS

Series 5000/HP Unpacked X-Ray Tubes Technical Data Sheet, X-Ray Technologies, Inc., Oxford Instruments, Feb. 16, 2007, 2 pages.

EDiX Miniature X-Ray Source, COMET 2005, http://www.comet/ch/security-inspection/industrial-x-ray/modules/ed..; printed Jun. 24, 2008, 1 page.

* cited by examiner

*Primary Examiner* — Irakli Kiknadze
(74) *Attorney, Agent, or Firm* — Gauthier & Connors LLP

(57) ABSTRACT

An x-ray system is disclosed that includes a bipolar x-ray tube. The bipolar x-ray tube includes two insulators that are separated by an intermediate electrode in an embodiment, wherein each insulator forms a portion of an outer wall of a vacuum envelope of the bipolar x-ray tube surrounding at least a portion of a path of an electron beam within the vacuum envelope. In further embodiments, the bipolar x-ray tube includes a first electrode at a positive high voltage potential with respect to a reference potential, a second electrode at a negative high voltage potential with respect to the reference potential, and an x-ray transmissive window that is at the positive high voltage potential.

27 Claims, 8 Drawing Sheets

COMPACT HIGH VOLTAGE X-RAY SOURCE SYSTEM AND METHOD FOR X-RAY INSPECTION APPLICATIONS

PRIORITY

This application claims priority to U.S. Provisional Patent Application Ser. No. 60/948,111 filed Jul. 5, 2007.

FIELD OF THE INVENTION

The present invention relates to systems and methods for providing compact X-ray sources for use in field portable or hand-held x-ray analytical instruments, and relates in particular to the design and construction of low power high voltage x-ray sources for use in field portable or hand-held x-ray analytical instruments.

BACKGROUND

Interest in the measurement of material properties using x-ray techniques has resulted in the development of compact, low power consumption x-ray sources for portable x-ray analytical instruments. Examples of such instruments are the hand-held x-ray fluorescence analyzers currently available from companies such as ThermoFisher Scientific Inc., Niton Analyzers, of Billerica, Mass., InnovX Systems of Woburn, Mass., and Oxford Instruments Company of Oxon, United Kingdom. In such conventional systems, however, the voltages of the x-ray sources have been generally limited because of the size requirements for the x-ray tube and the high voltage power supply, as well as the associated electrical insulation and radiation shielding requirements.

For example, as shown in FIG. 1, a portion of a conventional hand-held x-ray source may include an x-ray tube 10 within a housing 12 such that x-rays may be emitted by the x-ray tube through an x-ray output region 14 of the housing 12. The x-ray tube includes an anode end 16, a cathode end 18, and intermediate section 20 between the anode end 16 and the cathode end 18. The anode end 16 of the x-ray tube 10 includes an anode hood 22, an x-ray producing target 24, and an x-ray transmissive window 26. The cathode end 18 includes a cathode shroud 28, an electron emitter 34, and electrical connections 30 and 32 by which heater power is applied to the electron emitter 34. The intermediate section 20 may be formed of an electrical insulator such as ceramic or glass. The electrical insulator is sealed to the anode and cathode ends of the x-ray tube, thereby producing a interior region of the x-ray tube in which a vacuum can be produced and maintained.

During use, heater power is supplied to the cathode electron emitter 34, and a high voltage (e.g., 30-50 kV) is applied between the cathode end 18 and the anode end 16. The electric field produced by the applied high voltage accelerates electrons from the electron emitter through the vacuum to the x-ray producing target 24. The intensity of the x-rays produced at the target increases with increasing high voltage, electron beam current, and atomic weight of the target material. A portion of the x-rays produced in the target exit the tube via the x-ray transmission window 26, and exit the housing 12 via the x-ray output region 14 of the housing 12. The high voltage at the cathode end is typically provided as a negative high voltage (e.g., −50 kV) and the voltage potential at the anode end is typically provided at a reference ground potential of the system. This permits the anode end 16 of the tube 10 to be coupled directly to the housing 12. The x-ray tube 10 may be packaged in a hand held device that includes a high voltage power supply and a power source to drive the electron emitter.

For fixed values of the high voltage and electron current, the intensity of the x-rays at a location outside the x-ray tube decreases rapidly with increasing distance to the x-ray producing target. The x-ray intensity may be further reduced by the presence of intervening materials that scatter or absorb x-rays. Therefore, in order to maximize x-ray intensity at a given location, it is advantageous to minimize the distance from a sample or detector to the x-ray producing target and to eliminate to the extent possible any materials that scatter or absorb x-rays from the x-ray path. For these reasons, the x-ray producing target is placed as close as possible to the x-ray transmission window, and the x-ray transmission window is generally provided at an exterior surface of the housing at the output region. For example, the x-ray producing target and x-ray transmission window may be provided at a protruding portion or nose of a hand-held device, a portion of an example of which is shown in at 12 FIG. 1.

The accurate identification and quantification of elements at depths within certain materials, as well as the identification of certain heavy elements (e.g., lead and cadmium), generally requires the use of higher voltage sources (e.g., 80 to 150 kV) for x-ray production. Increasing the voltage level of the high voltage, however, generally requires that the length and diameter of the x-ray tube be increased in order to provide sufficient high voltage insulation between the anode and cathode conductors inside the vacuum envelope of the x-ray tube. Increased x-ray tube size therefore, requires an increase in the size of the hand-held x-ray inspection device. Further, providing sufficient electrical insulation between the housing and electrodes at significantly higher voltages also requires larger distances and thicker insulation. The doubling of the voltage level of a 50 kV tube, therefore, requires a substantial increase in size of a hand-held device that includes the higher voltage x-ray tube.

There remains a need, therefore, for a high voltage hand-held x-ray inspection device that is small-scale (uses a miniature x-ray source), yet is capable of operating in the range of approximately up to, for example, 150 kV.

SUMMARY OF THE INVENTION

A general object of the present invention is to provide a compact, self-shielded x-ray source for applications in which small size, low weight, and low power consumption are important.

Another object of the invention is to provide a miniature x-ray tube for use in hand-held or field-portable x-ray analytical instruments.

Another object of the invention is to provide a miniature x-ray tube and power supply module that is capable of operating at voltages up to 120 kV to 150 kV for use in hand-held or field-portable x-ray analytical instruments.

A further object of the invention is to provide a miniature x-ray tube and power supply module for use in hand-held XRF analyzers for the detection of lead in paint, solder, or other industrial materials.

A further object of the invention is to provide a miniature x-ray tube and power supply module for use in hand-held or field-portable XRF analyzers for the in vivo detection of lead in bone.

A further object of the invention is to provide a miniature x-ray tube and power supply module for use in hand-held x-ray imaging systems for security and medical applications.

In accordance with various embodiments, the invention provides an x-ray system that includes a bipolar x-ray tube. The bipolar x-ray tube includes two insulators that are separated by an intermediate electrode in an embodiment, wherein each insulator forms a portion of an outer wall of a vacuum envelope of the bipolar x-ray tube surrounding at least a portion of a path of an electron beam within the vacuum envelope. In further embodiments, the bipolar x-ray tube includes a first electrode at a positive high voltage potential relative to a reference potential, a second electrode at a negative high voltage potential relative to the reference potential, and an x-ray transmissive window that is at the positive high voltage potential.

In accordance with further embodiments, the invention provides an x-ray system that includes a housing, an x-ray tube, and an insulating region. The housing is at a reference potential, and the x-ray tube has an anode at a positive high voltage potential relative to the reference potential, and an x-ray transmissive window at the positive high voltage potential. The insulating region between the x-ray transmissive window and the housing, is electrically insulating and transmissive to x-rays.

In accordance with further embodiments, the invention provides an x-ray system that includes a bipolar x-ray tube with an anode and a cathode, a bipolar power supply for providing a positive high voltage potential relative to a reference potential and a negative high voltage potential relative to the reference potential, and a solid, electrically insulating material that encapsulates at least the cathode of the bipolar x-ray tube and the bipolar power supply.

In accordance with further embodiments, the invention provides an x-ray system that includes a bipolar x-ray tube, a bipolar power supply, a housing, and a passive cooling system. The bipolar x-ray tube includes an anode for receiving a positive high voltage potential with respect to a reference potential, a cathode for receiving a negative high voltage potential with respect to the reference potential, and an x-ray transmissive window. The bipolar power supply provides the positive high voltage potential relative to the reference potential and the negative high voltage potential relative to the reference potential. The housing is at the reference potential, and includes the bipolar x-ray tube and an x-ray output region that is aligned with the x-ray transmissive window of the x-ray tube. The passive cooling system is between the bipolar x-ray tube and the housing, and is for sufficiently cooling the bipolar x-ray tube during use. The passive cooling system may comprise a solid or a fluid.

In accordance with further embodiments, the invention provides a method of producing x-rays in a low power x-ray system. The method includes the steps of providing a positive high voltage potential relative to a reference potential to an anode of a bipolar x-ray tube, providing a negative high voltage potential relative to the reference potential to a cathode of the bipolar x-ray tube such that a difference voltage between the positive high voltage potential and the negative high voltage potential is employed between the anode and the cathode in the bipolar x-ray tube to cause electrons to impinge upon a target within the anode at an electron beam power of less than about 10 Watts and to thereby emit the x-rays through an x-ray transmission window of the bipolar x-ray tube, and emitting x-rays through an x-ray output region of a housing that includes the bipolar x-ray tube, wherein the x-ray output region is substantially aligned with the x-ray transmissive window of the bipolar x-ray tube.

BRIEF DESCRIPTION OF THE ILLUSTRATED EMBODIMENTS

The following description may be further understood with reference to the accompanying drawings in which.

The drawings are shown for illustrative purposes only, and are not to scale.

DETAILED DESCRIPTION

It has been discovered that a bipolar x-ray tube may be used in hand-held x-ray systems. Electrically insulating the high voltages of an x-ray tube from the typically grounded housing of hand-held x-ray sources is commonly achieved by maintaining the cathode at a negative high voltage potential within an electrically insulated portion of a source housing, while the anode (typically at system ground reference potential) is adjacent an output region of the housing.

Although bi-polar x-ray tubes generally use a positive high voltage potential in addition to a negative high voltage potential, it has been found that the high voltage potentials of a bipolar x-ray tube may be sufficiently electrically insulated within a hand-held source yet also produce sufficient output of x-rays through an x-ray output region of the device, and provide significantly higher x-ray energies than are possible with single polarity x-ray tubes.

Figure 1:
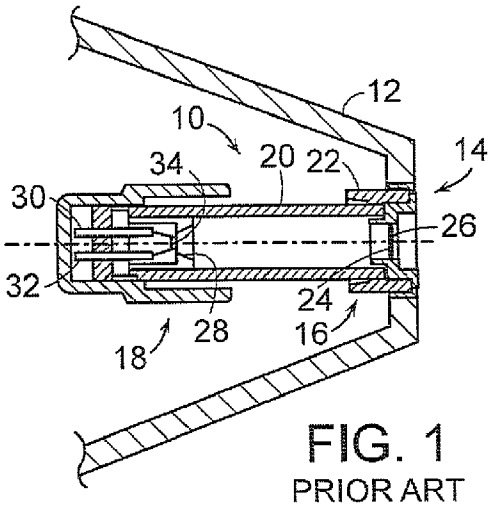
FIG. 1 PRIOR ART
FIG. 1 shows an illustrative diagrammatic sectional side view of a conventional x-ray tube.
Figure 2:
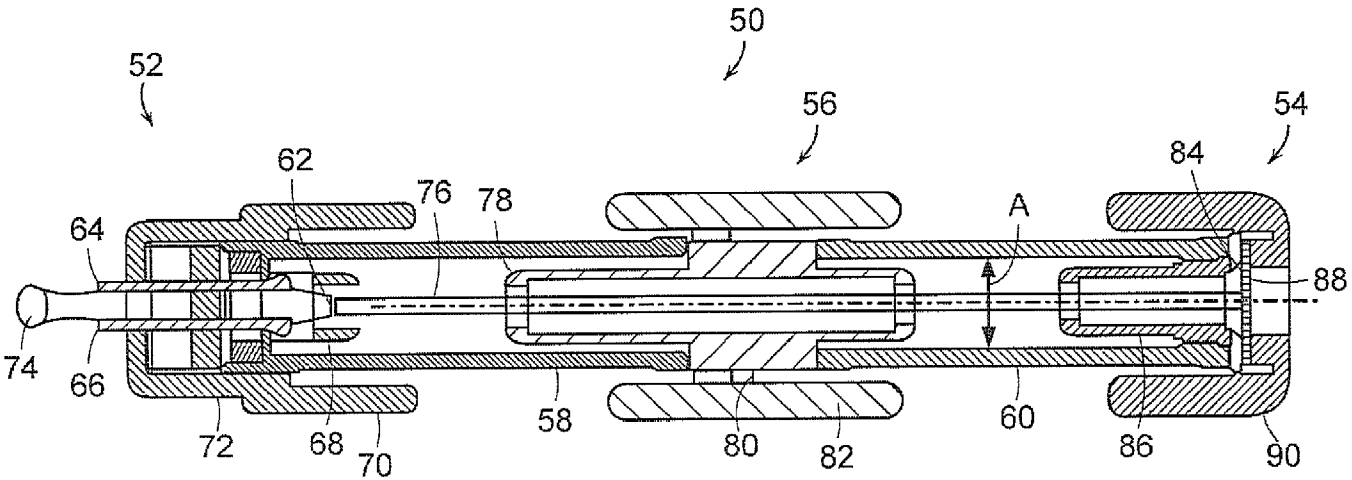
FIG. 2 shows an illustrative diagrammatic sectional side view of a bipolar x-ray tube having a transmission end-window in accordance with an embodiment of the invention.

As shown, in FIG. 2, a transmission end-window bipolar x-ray tube 50 in accordance with an embodiment of the invention includes a cathode 52, an anode 54, an intermediate electrode 56, and two insulators 58 and 60 on either side of the intermediate electrode 56. A vacuum is produced within the tube using a vacuum pump, and the tube is then sealed by closing off the pinch-off tube 74. The x-ray tube is maintained under vacuum after pinch-off using a vacuum getter 72. The cathode 52 includes an electron emitter 62 (such as a tungsten filament, a thoriated tungsten filament, an oxide-coated material, or other material with a low work function) across which a small potential may be applied via connecting pins 64 and 66 to cause the cathode to be heated and electrons to be emitted. Other means may also be employed to heat the electron emitter, such as laser illumination. The cathode 52 is maintained at a negative high voltage potential and includes a cathode shroud 68 and a negative high voltage shield 70 (such as tungsten, stainless steel, copper, brass or lead). In further embodiments, other electron sources may be employed at the cathode that are caused to emit electrons using other means such as photoemitters, field emitters, and cold emitters such as carbon nanotubes.

Within the vacuum, electrons are emitted along a path 76 and pass through an intermediate shroud 78 of the intermediate electrode 56. The intermediate electrode 56 also includes an intermediate conductor 80 as well as an intermediate shield 82, which may be formed of a material such as tungsten, stainless steel, copper, lead or brass.

The anode 54 is maintained at a positive high voltage potential, and includes an x-ray producing target 84 within an anode hood 86, and an x-ray transmission window 88. The anode 54 also includes a positive high voltage shield 90 formed, for example, of tungsten, stainless steel, copper, brass, or lead.

The miniature bipolar x-ray tube may be, for example, between about 2 to 4 inches in length (from the pinch-off tube 74 to the far end of the anode 54), and the tube itself may be about 0.2 to about 0.5 inches in diameter, and is preferably about 0.3 inches in diameter as shown at A in FIG. 2. Because the system employs a negative high voltage potential and a positive high voltage potential, the difference between any individual component and ground reference is at most the greater of the two potentials. For example, if the cathode is maintained at −50 kV, and the cathode is maintained at +50 kV, then the difference between any component in the system with respect to ground reference is only 50 kV. The bipolar x-ray tube 50 may preferably operate at an electron beam power of less than about 10 Watts, and more preferably may operate at an electron beam power of between about 0.1 Watt and about 5 Watts.

The intermediate electrode may be maintained at a voltage substantially half-way between the cathode and anode potentials, e.g., ground reference potential. As discussed in more detail below, the invention further provides a bipolar high voltage power supply connected to the x-ray tube, and that the x-ray tube, power supply and connection means are encapsulated in an electrically insulating material and enclosed in an electrically conducting sheath maintained at substantially ground reference potential. In certain embodiments, selected regions of the electrically insulating material may also contain x-ray shielding material. In accordance with other embodiments, the intermediate electrode may be omitted from a bipolar tube, using the positive and negative high voltage potentials at the anode and cathode respectively.

The embodiment of FIG. 2 uses a linear (as opposed to radial) insulator design that allows the diameter of the tube to be kept small. Small tube diameter in the vicinity of the x-ray window is advantageous in that it allows the x-ray source to be placed in close proximity to the sample being irradiated by the x-ray flux. Two cylindrical linear insulators separate the cathode and anode conductors, respectively, from the intermediate conductor. The insulators and the cathode, anode and intermediate electrode form the vacuum envelope of the tube.

The electron beam is generated by the electron emitter at cathode potential and accelerated to the x-ray emitting target at anode potential. In traversing the region between the cathode and anode conductors, the electron beam passes through the intermediate electrode, which is maintained at local reference ground potential. The total beam energy when it reaches the anode is the electron charge e multiplied by the total voltage change from the cathode to the anode. In the embodiment shown in FIG. 2, the magnitudes of the cathode and anode potentials are equal, and opposite in polarity, e.g., they may be both 50 kV in magnitude, with the cathode at −50 kV and the cathode at +50 kV. In other embodiments, it may be advantageous to operate the tube with different magnitudes of the cathode and anode potentials while still maintaining a desired beam energy. Using different potentials on these electrodes may alter the electron beam optics in the tube and may permit focusing or defocusing of the electron beam compared with the equal potential case.

The intermediate electrode 56 provides a benefit that the positive and negative regions of the tube are decoupled along the external and internal surfaces of the insulator, thereby reducing the probability of a full voltage arc along the insulated length of the tube. The positive and negative triple points where the two insulators join the intermediate conductor 80 are shielded by the intermediate shield 82 on the outside of the tube and by the intermediate shroud 78 on the vacuum side. Similarly, the triple points where the insulator sections 58 and 60 join the cathode and anode conductors are shielded by negative and positive high voltage shields 70 and 90 respectively on the outside of the tube and by the cathode shroud 68 and anode hood 86 on the vacuum side.

The intermediate shield 82 and the negative and positive high voltage shields 70 and 90 respectively may also provide additional x-ray shielding in the radial direction. The negative high voltage shield 70 may also provide x-ray shielding in the backwards axial direction, and the positive high voltage shield 90 may provide collimation of the x-ray beam in the forward axial direction. For this reason, the intermediate, negative, and positive shields may be made from a high atomic weight material such as tungsten, copper, brass, lead or other heavy metals.

The intermediate shroud 78 is configured as a conducting tube with apertures at either end. The length and diameter of the tube and apertures are chosen so as to provide a clear path for the accelerated electron beam while also helping to prevent stray ions or electrons produced in one half of the x-ray tube from reaching the other half. If the length of the intermediate conductor is significantly longer than its diameter, the region inside the conductor will be a region of low electric field and stray particles with large transverse velocity relative to their velocity along the axis of the tube will be collected on the walls of the tube with high probability. In this way, for example, secondary ions formed in the region of the x-ray tube surrounded by insulator 60 will be impeded from reaching the region of the x-ray tube surrounded by insulator 58, and secondary electrons produced in the latter region will be impeded from traveling to the former. This internal configuration helps to prevent the formation of discharges within the vacuum envelope.

Electrons produced at the cathode emitter travel trough the intermediate shroud 78 to the x-ray producing target 84. In this embodiment, the target is a thin coating of a selected material applied to the surface of the x-ray window. A portion of the x-rays produced in the target coating pass through the window 88 in the forward direction. Coating materials may include silver, gold, tungsten, rhenium or other metals and x-ray window materials may include beryllium, beryllium oxide, aluminum and other light materials. The anode hood 86 serves to prevent x-rays and stray electrons or ions from reaching the insulator surface and initiating high voltage breakdown.

Figure 3:
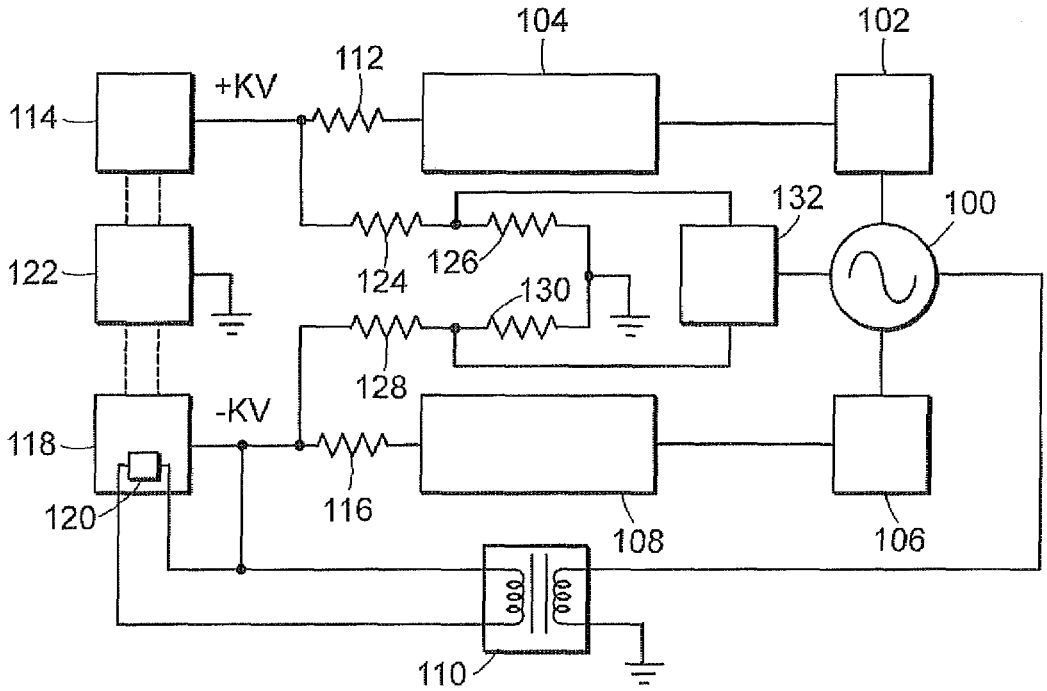
FIG. 3 shows an illustrative diagrammatic view of electrical components in a hand-held x-ray source system in accordance with an embodiment of the invention.

With reference to FIG. 3, a power supply oscillator 100, which may be either provided by an external oscillator via a cable or an internal oscillator system, and may be battery powered or powered from a cable, provides an oscillating signal to a first step-up transformer 102 that is coupled to a first voltage multiplier 104, and provides an oscillating signal to a second step-up transformer 106 that is coupled to a second voltage multiplier 108. A small voltage is also applied to an isolation transformer 110, the output of which will be used to heat the cathode emitter, 120, and produce electron emission from the cathode, 118. The output of the first voltage multiplier 104 is a positive high voltage potential (e.g., +20 kV to +70 kV) and is provided via a series resistor 112 to an anode 114 of a bipolar x-ray tube. The output of the second voltage multiplier 108 is a negative high voltage potential (e.g., −20 kV to −70 kV) and is provided via a series resistor 116 to a cathode 120 of a bipolar x-ray tube. The cathode 118 includes the electron emitter 120, and one side of the electron emitter 120 is coupled to the negative high voltage potential. An optional intermediate node is coupled to ground reference potential.

A feedback circuit may also be provided that maintains the positive and negative high voltage potentials at the desired levels, and the feedback circuit may include a voltage divider circuit including resistors 124, 126 for the positive high voltage output, and resistors 128, 131 for the negative high voltage output, each of which is coupled to a feedback controller as shown at 132. A feedback circuit may also be included (not shown) for stabilizing the electron beam current collected at the anode as is well known in the art.

The bipolar high voltage DC power supply therefore comprises two independently-controlled high frequency voltage multiplier circuits, each configured to reach a voltage corresponding to approximately half of the final electron beam energy in the x-ray tube. Examples of such multiplier circuits are cascade multipliers or Cockroft Walton voltage multipliers. A filament isolation transformer provides power to electron emitter, which may be a high temperature filament, or an oxide-coated or dispenser cathode. X-ray tube current is measured using a current sense resistor and high voltage is measured using a voltage divider resistor. In certain embodiments, an insulating encapsulant may surround the high voltage power supply, and the encapsulant may not contain x-ray shielding material, except in the regions adjacent to the bipolar x-ray tube. In other embodiments the high voltage insulation may be provided by an insulating liquid such as Fluorinert or oil.

Figure 4:
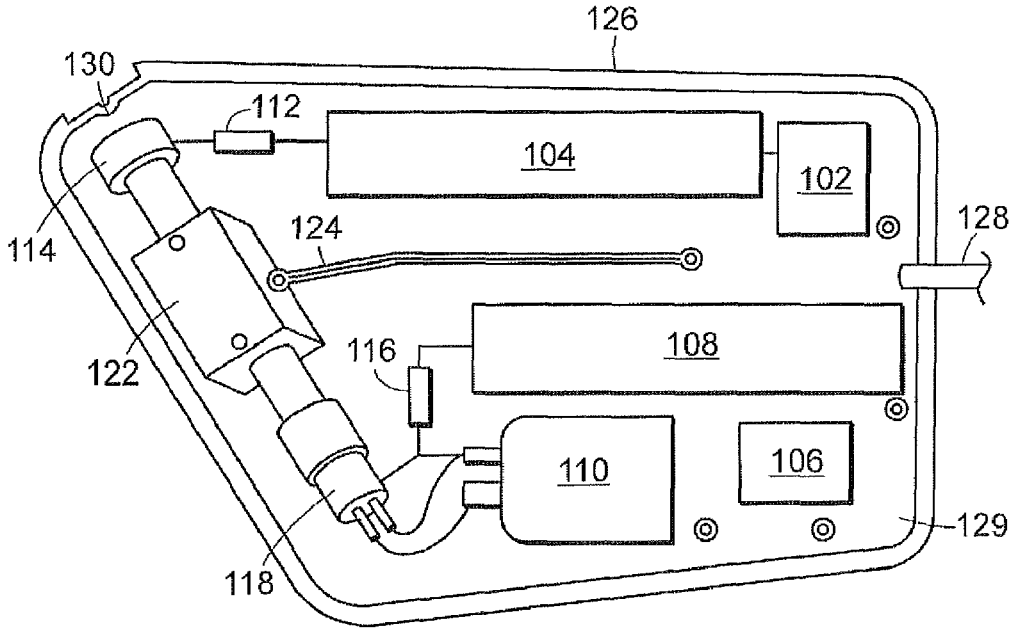
FIG. 4 shows an illustrative diagrammatic plan view of physical components in a hand-held x-ray system in accordance with an embodiment of the invention.

FIG. 4 shows a hand-held x-ray system in accordance with an embodiment of the invention that includes a bipolar x-ray tube including the anode 114, the intermediate electrode 122 and the cathode 118. The system also includes the first step-up transformer 102 and the first voltage multiplier 104, as well as the second step-up transformer 106 and the second voltage multiplier 108. The system further includes the high voltage isolation transformer 110 as well as a wall 124 at ground reference potential separating at least a portion of the first voltage multiplier 104 from the second voltage multiplier 108. The grounded wall 124 is also coupled to the intermediate electrode 122 as shown to contribute to electrical isolation of the positive high voltage potential from the negative high voltage potential.

The outputs of the voltage multipliers 104 and 108 are provided to the anode and cathode electrodes 114, 118 via series resistors 112 and 116 respectively as discussed above. The feedback circuit discussed above may be included with the voltage multipliers 104 and 108, and power is applied into the grounded housing 126 and the components therein via a power cable 128. Power may be provided by a battery, alternating currently supply, portable generator, solar cell or other source of electricity together with a local oscillator (not shown in FIG. 4) as is well known in the art.

FIG. 4 shows a top view of a lower half of a housing containing the tube and voltage supply with a top half of the housing removed. The interior region 129 of the housing 126 may be filled with air, but is preferably filled with an electrically insulating material in order to minimize the distance required between the internal components at high voltage and the housing 126 at reference ground potential. The interior region 129 provides a passive cooling system that permits the x-ray tube to be sufficiently cooled during use. Examples of materials that may be used in the region 129 are solid encapsulants such as silicone rubber or epoxy, liquids such as Fluorinert or oil, or insulating gases such as sulfur hexafluoride. The x-ray source housing 126 may be packaged, along with other components, within the housing of a hand-held x-ray instrument, such as an x-ray fluorescence materials analyzer, lead detector, x-ray imaging system, or medical therapy device.

Figure 5:
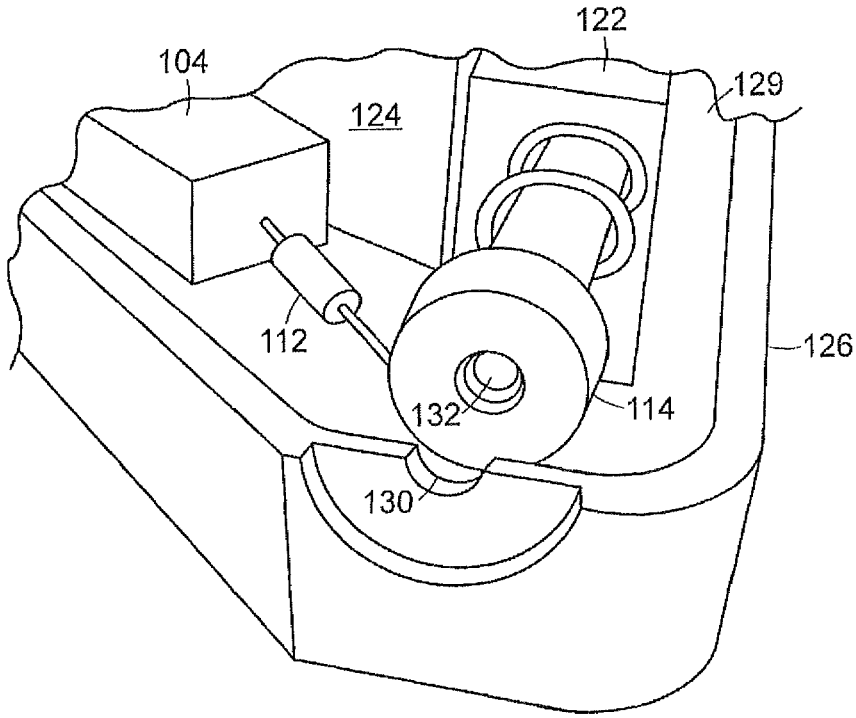
FIG. 5 shows an illustrative diagrammatic isometric view partial view of an anode end of a bipolar x-ray tube within a housing in accordance with an embodiment of the invention.

As further shown in FIG. 5, an x-ray output region, such as an aperture 130 of the housing 126, is aligned with an x-ray transmissive window 132 of the bipolar x-ray tube such that x-rays emitted through the x-ray transmissive window 132 exit the housing via the x-ray output aperture 130 of the housing 126. The positive high voltage multiplier 104 and associated series resistor 112 are also shown in FIG. 4, as well as the intermediate node 122 coupled to the grounded wall 124.

Figure 6:
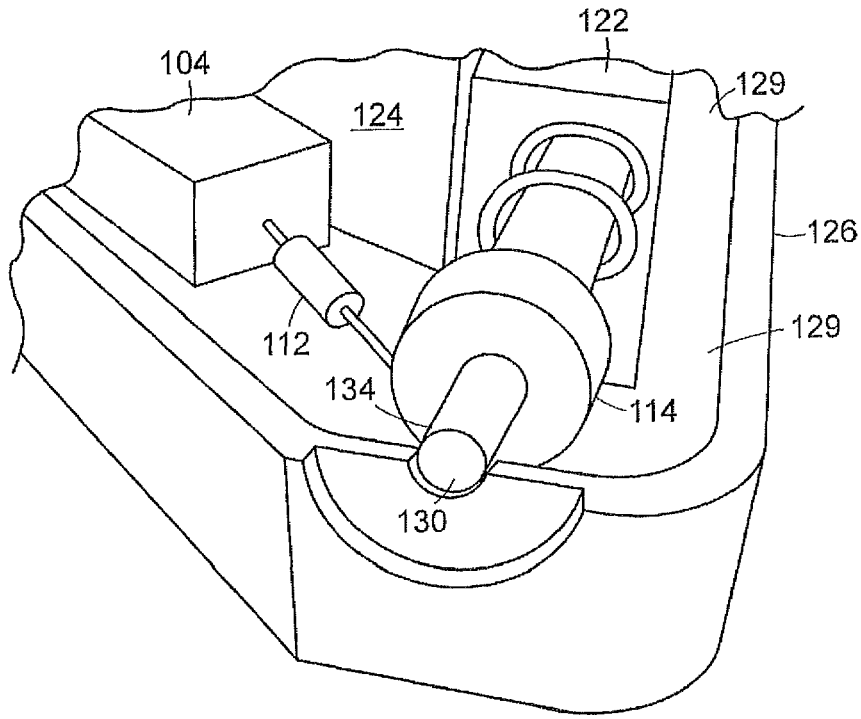
FIG. 6 shows an illustrative diagrammatic isometric view partial view of an anode end of a bipolar x-ray tube within a housing in accordance with another embodiment of the invention.

The region between the x-ray output aperture 130 and the x-ray transmissive window 132 must provide electrical insulation between the anode 114 at the positive high voltage potential an the housing 126 at the reference ground potential while being highly transparent to the x-rays emitted through the x-ray transmissive window 132. In certain embodiments, the region between the x-ray transmissive window 132 and the x-ray output aperture of the housing 130 may be filled with the same material that fills the remainder of the interior region 129 (as shown in FIG. 4). This may be acceptable if the material that fills the interior region 129 is itself relatively transmissive to the x-ray flux. In other embodiments as shown, for example in FIG. 6, the x-ray output interface may include a different material or component 134 that provides electrical insulation of the anode, which is at the positive high voltage potential, yet also provides that x-rays are freely transmitted through the material or component as shown in FIG. 6. The remaining components of FIG. 6 are the same as those of FIG. 5.

Figure 7A:
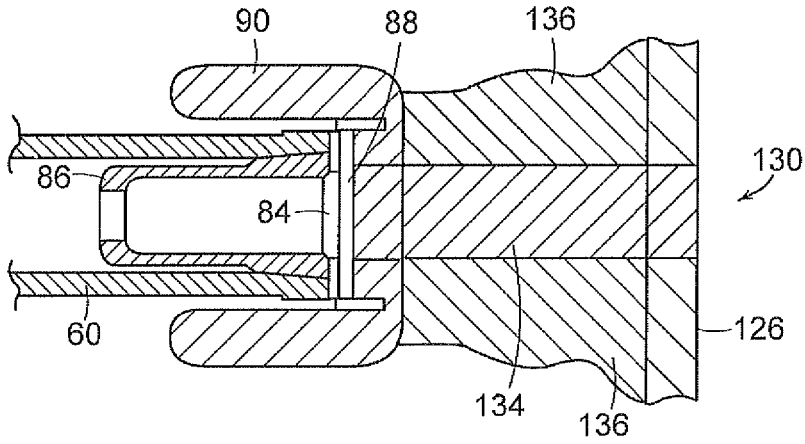
FIGS. 7A-7C show illustrative diagrammatic sectional views of output transmission interfaces between housings and anode ends of a bipolar x-ray tubes in accordance with further embodiments of the invention.
Figure 7B:
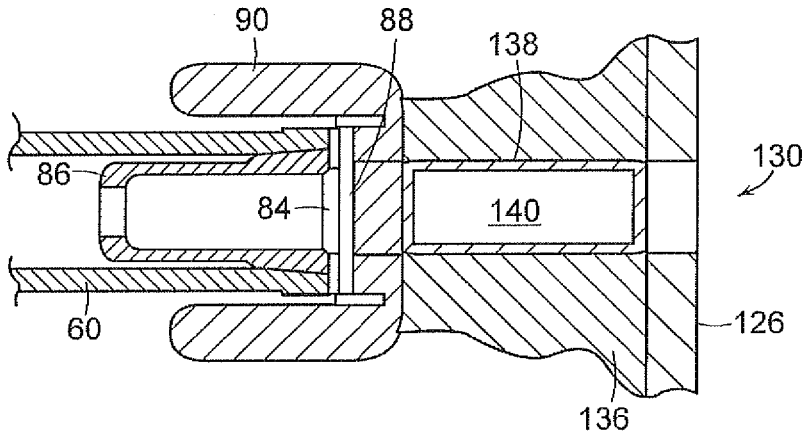
Figure 7C:
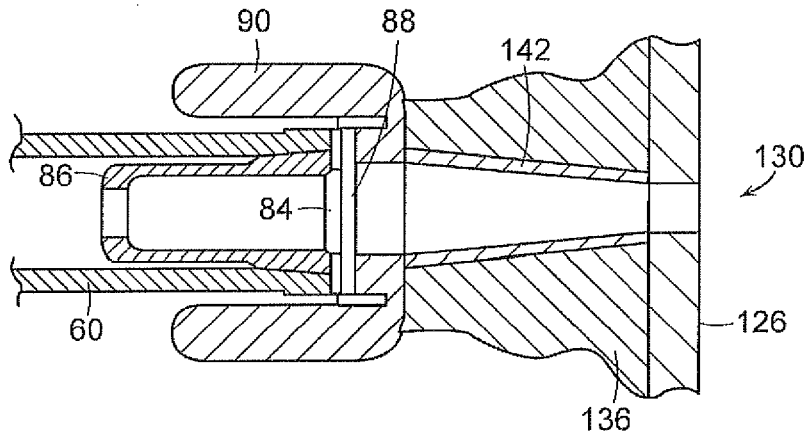

For example, FIGS. 7A-7C show certain examples of x-ray output interfaces that may be employed. In FIG. 7A, the material 134 is provided as an electrically insulating, x-ray transmissive solid potting material such as, for example, RTV, silicone rubber, epoxy, and urethane. The output transmission interface is provided between the x-ray transmissive window 88, through an opening in the anode high voltage shield 90, and extends to the output aperture 130 of the housing 126. In accordance with certain embodiments, a solid potting material 136 is provided around the remaining portions of the x-ray tube. The potting material 136 provides a passive cooling system that permits the x-ray tube to be sufficiently cooled during use. The potting material 136 is also electrically insulating and x-ray absorbing to provide radiation shielding from x-rays emanating from the x-ray tube through surfaces other that the x-ray transmissive window 88 Such materials include RTV, silicone rubber, epoxy and urethane potting materials impregnated with shielding materials such as lead, lead oxide, bismuth oxide, tungsten powder, and tungsten oxide.

As shown in FIG. 7B, the output transmission interface may employ a sealed tube 138 that may, for example, provide a vacuum 140 within the tube 138. Alternately, the vacuum region 140 may also be connected directly into an evacuated region of the x-ray tube assembly. In accordance with other embodiments, the sealed tube 138 may contain an electrically insulating gas or liquid that is relatively transmissive to x-rays. Examples are sulfur hexafluoride gas, Fluorinert, or oil. As shown in FIG. 7C, the size of the opening in the x-ray output aperture 130 may be smaller than the diameter of the x-ray transmissive window 88. FIG. 7C shows an x-ray flux shaper element 142 that provides a smaller diameter x-ray beam. In other embodiments, the field shaper element 142 may have other shapes and opening sizes to provide collimation or shaping of the x-ray flux. The remaining portions of the output transmission interfaces of FIGS. 7B and 7C are similar to those discussed above.

Figure 8:
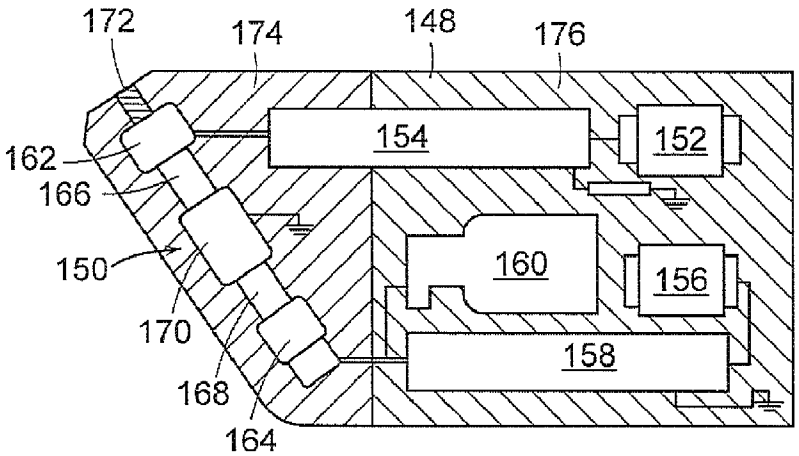
FIG. 8 shows an illustrative diagrammatic plan view of physical components in a hand-held x-ray source in accordance with a further embodiment of the invention.

In accordance with a further embodiment as shown in FIG. 8, the invention provides a housing 148 for a bipolar x-ray tube 150 and a bipolar voltage source that includes first step-up transformer 152 coupled to a positive high voltage multiplier 154, and a second step up transformer 156 coupled to a negative high voltage multiplier 158. The voltage source is provided by battery or an alternating currently supply, together with a local oscillator (not shown in FIG. 8) as is well known in the art. The system also includes an isolation transformer 160, and the positive high voltage potential is applied to an anode 162 of a bipolar x-ray tube 150, while the negative high voltage potential is applied to a cathode 164 of the x-ray tube 150 as discussed above. The bipolar x-ray tube 150 may preferably operate at an electron beam power of less than about 10 Watts, and more preferably may operate between about 1 Watt and 5 Watts. The housing 126 may also be packaged within a further device housing in a hand-held x-ray instrument.

The system also includes two insulators 166 and 168 on either side of an intermediate electrode 170 that is coupled to a system reference ground. The embodiment of FIG. 8 also includes an x-ray transmissive electrically insulating potting material 172 between the x-ray transmissive window of the bipolar x-ray tube and the output region of the housing. The system further includes an electrically insulating encapsulating material 174 that contains x-ray shielding material surrounding the bipolar x-ray tube 150, and an electrically insulating material 176 that does not contain x-ray shielding material surrounding the bipolar high voltage supply. The encapsulating material 174 as discussed above that provides a passive cooling system that permits the x-ray tube to be sufficiently cooled during use.

In the embodiment of FIG. 8, therefore, the x-ray tube, power supply, and connection means are encapsulated in solid electrically insulating encapsulant. Preferred encapsulating materials include silicone rubbers and epoxies. The x-ray tube and power supply components are positioned so as to minimize the required distance between components and thickness and total quantity of insulating material surrounding the components. The portion of the electrically insulating material adjacent to the x-ray tube contains x-ray shielding material distributed within. The x-ray shielding material and concentration is selected so as not to compromise the electrically insulating properties of the encapsulant. Preferred shielding materials include oxides of bismuth, tungsten and other heavy metals in fine powder form. The electrically insulating material in regions away from the x-ray tube do not contain x-ray shielding material in order to reduce the weight and cost of the device.

The x-ray transmission interface 172 may be filled with encapsulating material that is left free from x-ray shielding material, thus allowing the x-rays to pass to the outside of the module with minimal attenuation and scattering. The thickness of this region is kept as small as possible to permit efficient transmission of x-rays. This thickness is typically less than 0.5 inches thick and preferably between 0.1 and 0.3 inches thick. This shielding-free channel provides collimation of the x-ray beam, and the shape of this region may be chosen to provide the desired x-ray beam spatial profile as discussed above with reference to FIGS. 6 and 7A-7C. In accordance with other embodiments, if attenuation and scattering of the x-ray beam in the encapsulant material is an issue, the x-ray transmission interface 172 between the x-ray tube window and the outer surface of the encapsulant may be filled with sulfur hexafluoride gas, either pressurized or at atmospheric pressure. Sulfur hexafluoride gas is preferred for certain applications because it is an excellent electrical insulator and because its high molecular weight makes it easy to contain in a sealed cavity.

Figure 9:
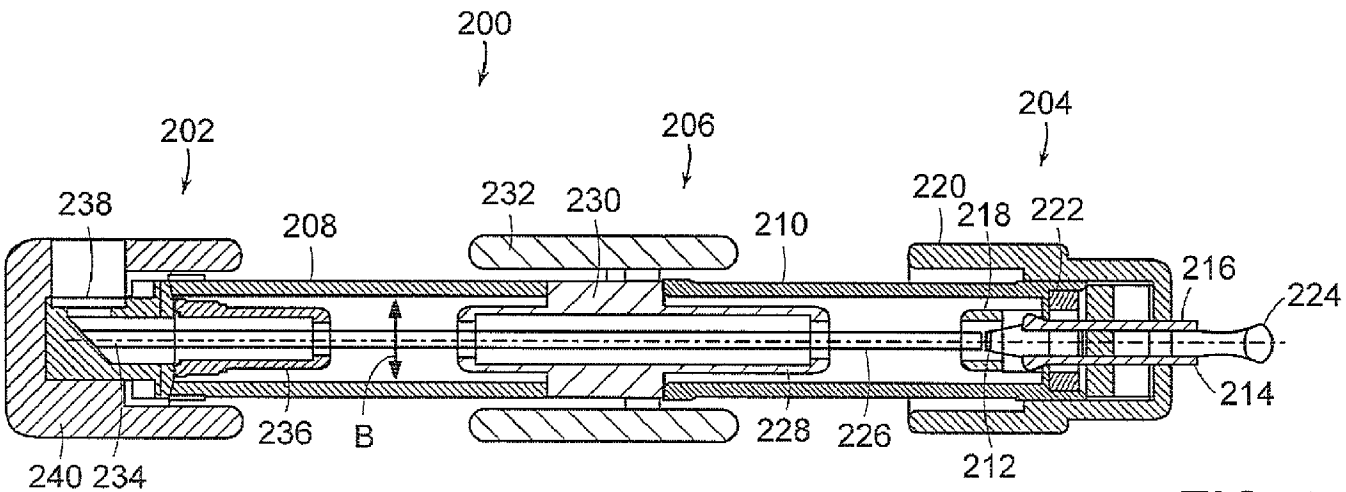
FIG. 9 shows an illustrative diagrammatic sectional side view of a bipolar x-ray tube having a side window in accordance with a further embodiment of the invention.

In accordance with a further embodiment as shown in FIG. 9, a system of the invention may include a side-window bipolar x-ray tube 200 that includes an anode 202, a cathode 204, an optional intermediate electrode 206, and two insulators 208 and 210, e.g., ceramic insulators, on either side of the intermediate electrode 206. The cathode 204 includes a cathode electron emitter 212 (such as tungsten, thoriated tungsten, an oxide, or tantalum) across which a small potential may be applied via connecting pins 214, 216 to cause heating and electrons to be emitted. In further embodiments, other electron sources may be employed at the cathode that are caused to emit electrons using other means such as laser illumination or cold emission. The cathode 204 is maintained at a negative high voltage potential and includes a cathode shroud 218 and a negative high voltage shield 220 (made from a material such as tungsten, stainless steel, copper, brass, or lead). A vacuum is obtained within the tube by evacuating and closing off the tube at the pinch-off tube 224, and is maintained in the tube using a vacuum getter 222. The bipolar x-ray tube 200 may preferably operate at an electron beam power of less than about 10 Watts, and more preferably may operate at an electron beam power of between about 1 Watt and about 5 Watts.

Within the vacuum, electrons are emitted along a path 226 and pass through an intermediate shroud 228 of the intermediate electrode 206. The intermediate electrode 206 also includes an intermediate conductor 230 as well as an intermediate shield 232, which may be formed of a high atomic weight material such as tungsten, stainless steel, copper, brass, lead or other heavy metal.

The anode 202 is maintained at a positive high voltage potential, and includes an x-ray producing target 234 within an anode hood 236 and an x-ray transmission window 238. The anode 202 also includes a positive high voltage shield 240 formed, for example, of a tungsten, stainless steel, copper, brass, or lead.

The miniature bipolar x-ray tube may be, for example, between about 2 to 4 inches in length (from the pinch-off tube 224 to the far end of the anode 202), and the tube itself may be about 0.2 to about 0.5 inches in diameter, and is preferably about 0.3 inches in diameter as shown at B in FIG. 9. Again, because the system employs a negative high voltage potential and a positive high voltage potential, the difference between any individual component and ground reference is at most the greater of the two potentials. For example, if the cathode is maintained at −50 kV, and the cathode is maintained at +50 kV, then the difference between any component in the system with respect to ground is only 50 kV. The intermediate electrode may be maintained at a voltage substantially half-way between the cathode and anode potentials, e.g., ground potential.

Figure 10:
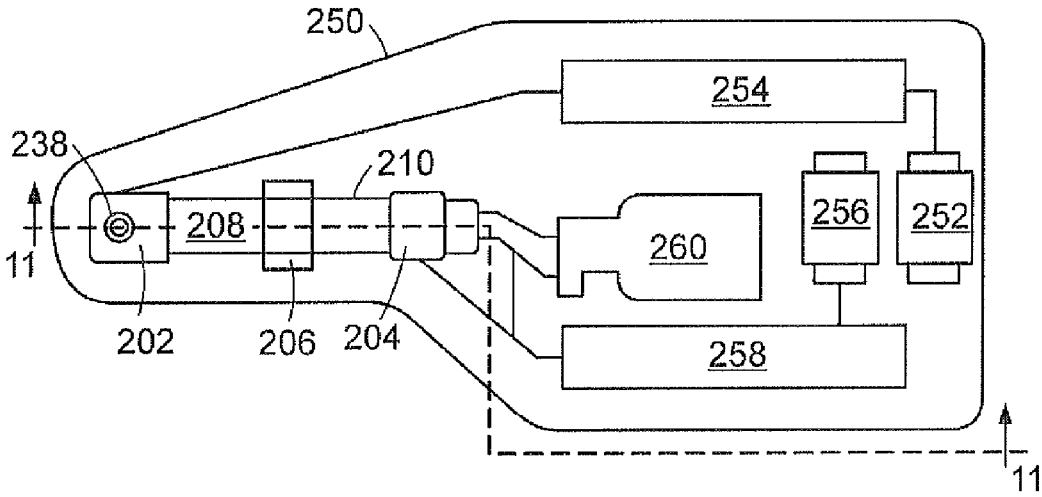
FIG. 10 shows an illustrative diagrammatic plan view of physical components in a hand-held x-ray source in accordance with a further embodiment of the invention.
Figure 11:
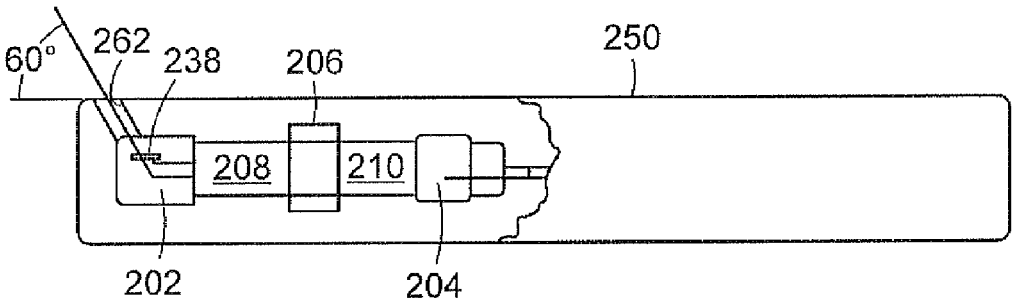
FIG. 11 shows a partial sectional side view of the hand-held x-ray source shown in FIG. 11 taken along line 11-11 thereof.

As further shown in FIGS. 10 and 11, the bipolar x-ray tube 200 may be provided within a housing 250 that also includes a bipolar high voltage supply. In particular, a step-up transformer 252 is coupled to a positive high voltage multiplier 254, and another step-up transformer 256 is coupled to a negative high voltage multiplier 258. An isolation transformer 260 provides a small voltage potential to the electron emitter 212 in the cathode via connecting pins 214 and 216. The two cylindrical linear insulators separate the cathode and anode conductors, respectively, from the intermediate conductor. The insulators and the cathode, anode and intermediate electrode form the vacuum envelope of the tube.

Similar to the embodiment of FIG. 2, the electron beam is generated by the electron emitter at cathode potential and accelerated to the x-ray emitting target at anode potential. In traversing the region between the cathode and anode conductors, the electron beam passes through the intermediate electrode, which is maintained at local reference ground potential. The total beam energy when it reaches the anode is the electron charge e multiplied by the total voltage change from the cathode to the electrode. In the embodiment shown in FIG. 9, the magnitudes of the cathode and anode potentials are equal, and opposite in polarity, but other embodiments, it may be advantageous to operate the tube with different magnitudes of the cathode and anode potentials while still maintaining a desired beam energy as discussed above with reference to FIG. 2.

Electrons produced at the cathode emitter 212 travel through the intermediate shroud 230 to the x-ray producing target 234. The x-ray producing target may be a solid piece of target material or a thin layer of target material applied to a substrate and disposed at an angle to the direction of the electron beam path. In this embodiment, a portion of the x-rays produced in the target 234 impinge on the x-ray transmissive window 238. The portion of the x-rays that reach the window 238 are passed out of the bipolar x-ray tube through an x-ray output transmission interface 262 disposed between the x-ray transmissive window 238 and the housing 250 (shown in FIG. 11). The x-ray transmissive interface 262 may be configured as discussed previously and shown in FIGS. 6, 7A-C, and 8. The x-ray producing target material may include silver, gold, tungsten, rhenium or other metals, and the x-ray transmissive window materials may include beryllium, beryllium oxide, aluminum and other light materials. The anode hood 236 serves to prevent x-rays and stray electrons or ions from reaching the insulator surface and initiating high voltage breakdown.

Figure 12:
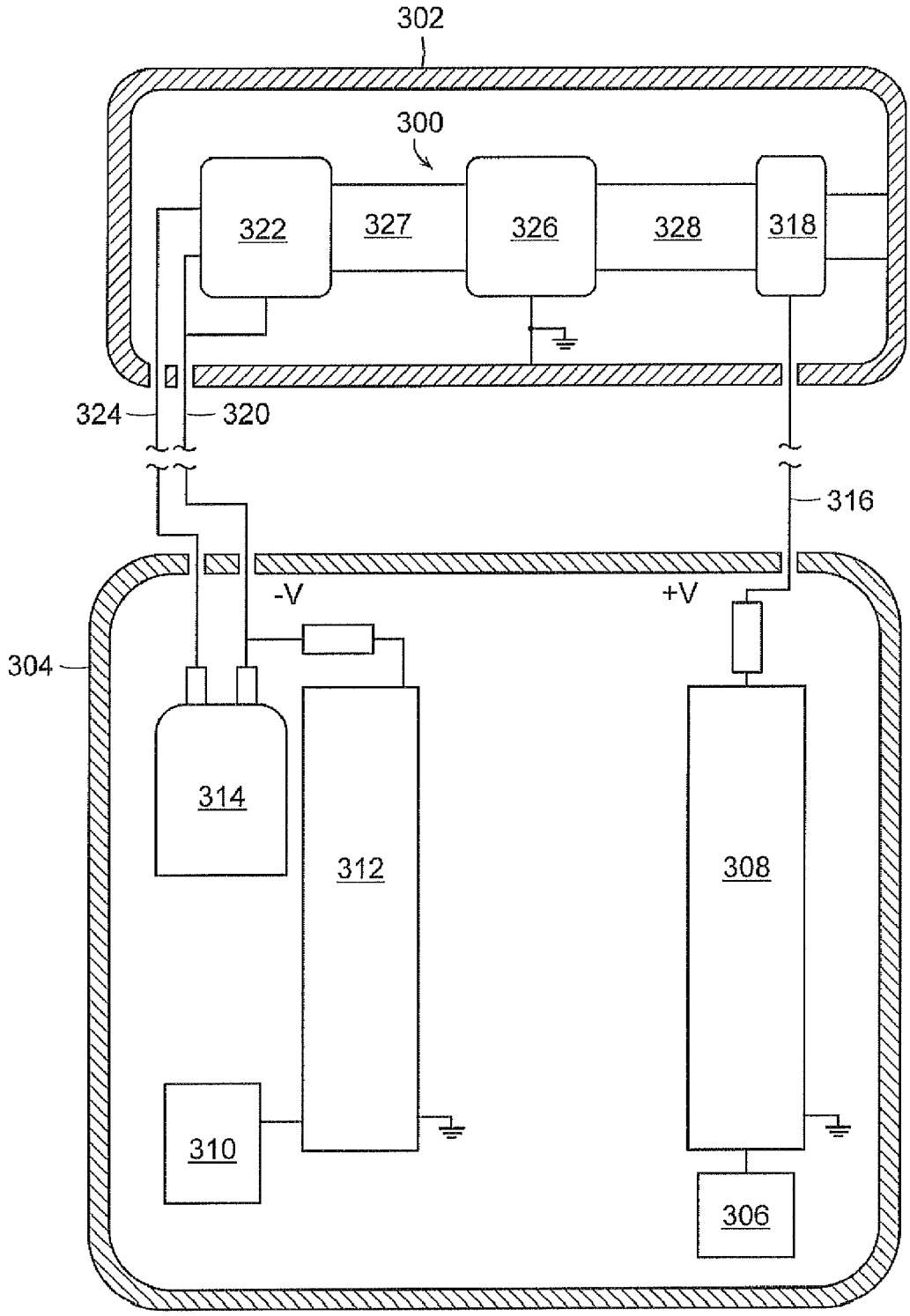
FIG. 12 shows an illustrative diagrammatic plan view of physical components in a hand-held x-ray source in accordance with a further embodiment of the invention.

In accordance with a further embodiment shown in FIG. 12 a hand-held system of the invention includes a bipolar x-ray tube 300 within a housing 302, and a bipolar high voltage power supply within a different housing 304. The bipolar high voltage power supply includes a step-up transformer 306 coupled to a positive high voltage multiplier 308, and another step-up transformer 310 coupled to a negative high voltage multiplier 312. The positive high voltage multiplier 308 provides the positive high voltage via cables 316 to an anode 318 of the bipolar x-ray tube 300, while the negative high voltage multiplier 312 provides the negative high voltage via cables 320 to a cathode 322 of the bipolar x-ray tube 322. The cathode emitter voltage (with respect to the cathode high voltage) is provided by the isolation transformer 314 via cables 324 to an electron emitter within the cathode 322. The bipolar x-ray tube 300 may preferably operate at an electron beam power of less than about 10 Watts, and more preferably may operate at an electron beam power of between about 1 Watt and about 5 Watts.

An optional intermediate electrode 326 may be included between ceramic insulators 327 and 328, and may be coupled to a system reference ground. The system of FIG. 12 permits the bipolar x-ray tube to be decoupled from the bipolar high voltage power supply. Power may be provided to the high voltage power supply within the housing 304 by a battery, alternating currently supply, portable generator, solar cell or other source of electricity together with a local oscillator, as is well known in the art. FIG. 12 shows a top view of a lower halves of housings 302 and 304 containing the tube and voltage supply respectively, with the top halves of the housings removed. The housings 302 and 304 may be packaged within a further device housing in a hand-held x-ray instrument.

Figure 13:
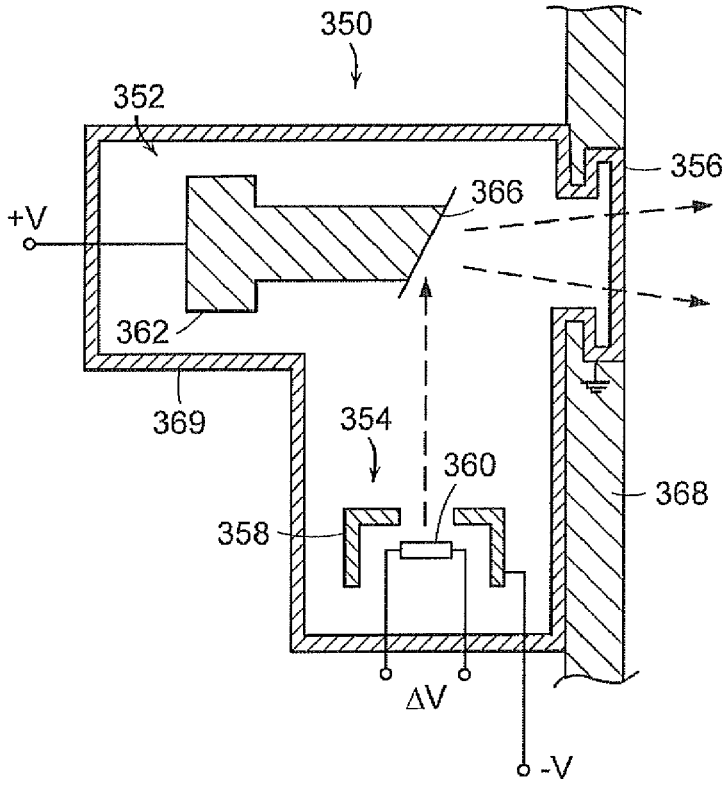
FIG. 13 shows an illustrative diagrammatic sectional view of a bipolar x-ray tube within a housing in a hand-held x-ray system in accordance with another embodiment of the invention.

As shown in FIG. 13, a bipolar x-ray tube 350 may be provided in a hand-held system in accordance with a further embodiment of the invention, in which the x-ray tube 350 includes in a vacuum environment, an electrically insulating wall 369, an anode 352, a cathode 354, and an x-ray transmissive output window 356. The cathode 354 includes a cathode shroud 358 coupled to a negative high voltage potential, and a cathode electron emitter 360 which may be heated. The anode 352 includes a positive high voltage electrode 362 coupled to a positive high voltage potential. A solid target 366 is provided in the path of the electron beam such that a portion of the x-rays are emitted may pass through the x-ray transmissive window 356 that is formed into a housing 368. In this embodiment, the x-ray transmissive window 356 may be provided at reference ground potential.

Figure 14:
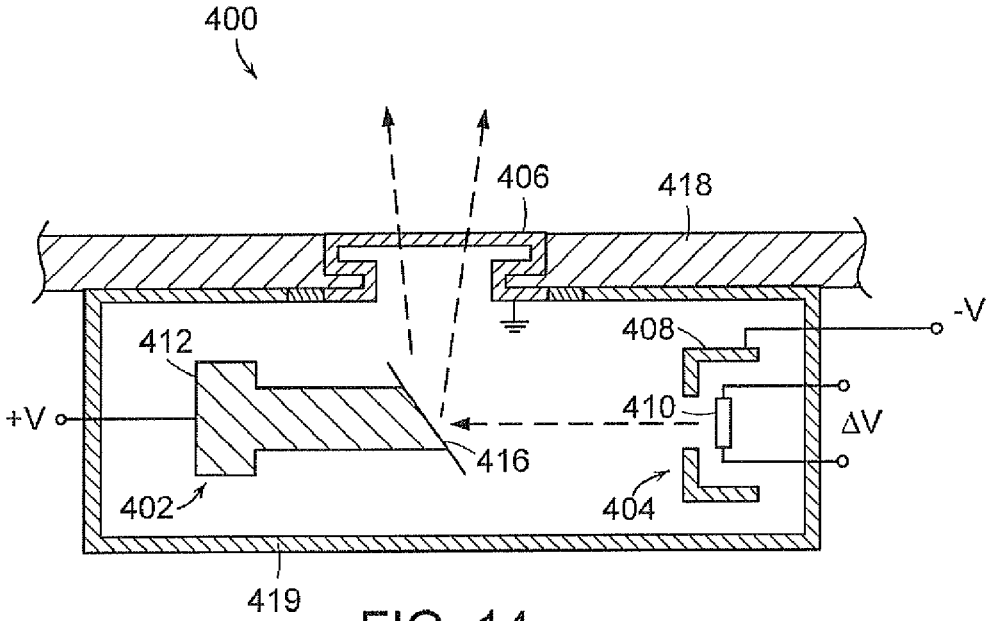
FIG. 14 shows an illustrative diagrammatic sectional view of a bipolar x-ray tube within a housing in a hand-held x-ray system in accordance with a further embodiment of the invention.

FIG. 14, shows a bipolar x-ray tube 400 that may be provided in a hand-held system in accordance with a further embodiment of the invention, in which the x-ray tube 400 includes in a vacuum environment, an electrically insulating wall 419, an anode 402, a cathode 404, and an x-ray transmissive output window 406. The cathode 404 includes a cathode shroud 408 coupled to a negative high voltage potential, and a cathode electron emitter 410 which may be heated. The anode 402 includes a positive high voltage electrode 412 coupled to a positive high voltage potential. A solid target 416 is provided in the path of the electron beam such that x-rays are emitted and may pass through the x-ray transmissive window 406 that is formed into a housing 418. In this embodiment, the x-ray transmissive window 406 may be provided at reference ground potential.

In the example of FIG. 14, the anode and the cathode directly oppose one another, and in both of the embodiments of FIGS. 13 and 14, the difference between the negative high voltage potential and the positive high voltage potential is employed to cause electrons to be directed toward the x-ray producing target. The bipolar x-ray tubes of FIGS. 13 and 14 may each be encapsulated in x-ray shielding and voltage insulating potting material as discussed above. The bipolar x-ray tubes 350 and 400 may each preferably operate at less than about 10 Watts, and more preferably may operate between about 1 Watt and 5 Watts. The solid target materials 366 and 416 may each include silver, gold, tungsten, rhenium or other metals, and the x-ray transmissive window materials 356 and 406 may each include beryllium, beryllium oxide, aluminum and other light materials.

The positive high voltage potential and the negative high voltage potential may be provided as discussed above in connection with each of the previous embodiments, employing step up transformers and voltage multipliers. The power source may be provided by battery or an alternating currently supply, together with a local oscillator as is well known in the art. The housing 368 and 418 of the embodiments of FIGS. 13 and 14 may be packaged within a further device housing in a hand-held x-ray instrument.

Those skilled in the art will appreciate that numerous modifications and variations may be made to the above disclosed embodiments without departing from the spirit and scope of the invention.

What is claimed is:

1. A bipolar x-ray tube comprising two insulators that are separated by an intermediate electrode, wherein each insulator forms a portion of an outer wall of a vacuum envelope of the bipolar x-ray tube surrounding at least a portion of a path of an electron beam within the vacuum envelope, wherein said bipolar x-ray tube further includes an anode at a positive high voltage potential relative to a reference potential, a cathode at a negative high voltage potential relative to the reference potential, and an x-ray transmissive window at the positive high voltage potential, and wherein said x-ray transmissive window includes an x-ray producing target on an inside surface thereof that is within the vacuum envelope.

2. The x-ray system as claimed in claim 1, wherein said x-ray system further includes an x-ray transmissive electrical insulator adjacent an outside surface of the x-ray transmissive window.

3. The x-ray system as claimed in claim 1, wherein the intermediate electrode is at an intermediate potential that is between the positive high voltage potential and the negative high voltage potential.

4. The bipolar x-ray tube as claimed in claim 1, wherein each insulator is cylindrical in shape and is formed of ceramic, and wherein said intermediate electrode is at a potential that is a system reference ground.

5. The bipolar x-ray tube as claimed in claim 1, wherein said bipolar x-ray tube is configured to operate with an electron beam power of less than about 10 Watts.

6. An x-ray system comprising:

a housing at a reference potential;

an x-ray tube having an anode at a positive high voltage potential relative to the reference potential, and an x-ray transmissive window at the positive high voltage potential; and an insulating region between the x-ray transmissive window and the housing, wherein said insulating region is electrically insulating and transmissive to x-rays.

7. The x-ray system as claimed in claim 6, wherein said insulating region is filled with a solid material.

8. The x-ray system as claimed in claim 6, wherein said insulating region includes an evacuated region.

9. The x-ray system as claimed in claim 6, wherein said insulating region includes a fluid.

10. The x-ray system as claimed in claim 6, wherein said x-ray tube further includes a cathode at a negative high voltage potential with respect to the reference potential.

11. The x-ray system as claimed in claim 10, wherein said bipolar x-ray tube is configured to operate with an electron beam power of less than about 10 Watts.

12. The system as claimed in claim 10, wherein said x-ray tube further includes an intermediate electrode at the reference potential.

13. The x-ray system as claimed in claim 12, wherein said x-ray tube includes two insulators separated by the intermediate electrode, wherein each insulator forms a portion of an outer wall of a vacuum envelope of the x-ray tube surrounding at least a portion of a path of an electron beam within the vacuum envelope.

14. An x-ray system comprising:

a bipolar x-ray tube including an anode and a cathode;

a bipolar power supply for providing a positive high voltage potential relative to a reference potential and a negative high voltage potential relative to the reference potential; and a solid, electrically insulating material that encapsulates at least the cathode of the bipolar x-ray tube and the bipolar power supply.

15. The x-ray system as claimed in claim 14, wherein said bipolar x-ray tube further includes an intermediate electrode between the anode and the cathode, and wherein the intermediate electrode is at a voltage potential that is between the positive high voltage potential and the negative high voltage potential.

16. The x-ray system as claimed in claim 14, wherein said bipolar x-ray tube includes an x-ray transmissive window that is at the positive high voltage potential.

17. The x-ray system as claimed in claim 14, wherein said bipolar x-ray tube includes an x-ray transmissive window that is at the reference potential.

18. A method of producing x-rays in a low power x-ray system, said method comprising the steps of:

providing a positive high voltage potential relative to a reference potential to an anode of a bipolar x-ray tube;

providing a negative high voltage potential relative to the reference potential to a cathode of the bipolar x-ray tube such that a difference voltage between the positive high voltage potential and the negative high voltage potential is employed between the anode and the cathode in the bipolar x-ray tube to cause electrons to impinge upon a target within the anode at an electron beam power of less than about 10 Watts, and to thereby emit the x-rays through an x-ray transmission window of the bipolar x-ray tube; and emitting x-rays through an x-ray output region of a housing that includes the bipolar x-ray tube, wherein the x-ray output region is substantially aligned with the x-ray transmissive window of the bipolar x-ray tube.

19. The method as claimed in claim 18, wherein said x-ray transmissive window is at the positive high voltage potential.

20. The method as claimed in claim 18, wherein said x-ray transmissive window is at the reference potential.

21. The method as claimed in claim 18, wherein said bipolar x-ray tube further includes an intermediate electrode between the cathode and the anode.

22. The method as claimed in claim 21, wherein said intermediate electrode is at the reference potential.

23. A bipolar x-ray tube comprising two insulators that are separated by an intermediate electrode, wherein each insulator forms a portion of an outer wall of a vacuum envelope of the bipolar x-ray tube surrounding at least a portion of a path of an electron beam within the vacuum envelope, wherein said bipolar x-ray tube further includes an anode at a positive high voltage potential relative to a reference potential, a cathode at a negative high voltage potential relative to the reference potential, and an x-ray transmissive window at the positive high voltage potential, and wherein said x-ray system further includes an x-ray transmissive electrical insulator adjacent an outside surface of the x-ray transmissive window.

24. The x-ray system as claimed in claim 23, wherein said x-ray producing target is on an inside surface of said x-ray transmissive window and is within the vacuum envelope.

25. The x-ray system as claimed in claim 23, wherein the intermediate electrode is at an intermediate potential that is between the positive high voltage potential and the negative high voltage potential.

26. The bipolar x-ray tube as claimed in claim 23, wherein each insulator is cylindrical in shape and is formed of ceramic, and wherein said intermediate electrode is at a potential that is a system reference ground.

27. The bipolar x-ray tube as claimed in claim 23, wherein said bipolar x-ray tube is configured to operate with an electron beam power of less than about 10 Watts.

* * * * *